US007800883B2

(12) United States Patent
Nederegger

(10) Patent No.: US 7,800,883 B2
(45) Date of Patent: Sep. 21, 2010

(54) FUEL FLANGE WITH DISCHARGE STRUCTURE TO DISCHARGE CONDUCTIVE HOSES

(75) Inventor: Matthias Nederegger, Rochester Hills, MI (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 975 days.

(21) Appl. No.: 11/601,682

(22) Filed: Nov. 20, 2006

(65) Prior Publication Data

US 2007/0144608 A1 Jun. 28, 2007

Related U.S. Application Data

(60) Provisional application No. 60/738,817, filed on Nov. 22, 2005.

(51) Int. Cl.
*H05F 3/00* (2006.01)
*F02M 37/04* (2006.01)

(52) U.S. Cl. ..... 361/215; 123/509

(58) Field of Classification Search ..... 361/215; 123/509

See application file for complete search history.

(56) References Cited

U.S. PATENT DOCUMENTS

| | | | | |
|---|---|---|---|---|
| 4,945,884 | A * | 8/1990 | Coha et al. | 123/509 |
| 2004/0011129 | A1 * | 1/2004 | Gilmour et al. | 73/313 |
| 2004/0169990 | A1 * | 9/2004 | Wada | 361/212 |
| 2006/0213486 | A1 * | 9/2006 | Powell et al. | 123/509 |

* cited by examiner

*Primary Examiner*—Stephen W Jackson
*Assistant Examiner*—Scott Bauer

(57) ABSTRACT

A flange and hose assembly is provided for a fuel supply unit of a vehicle. The assembly includes a plastic flange 12 and an electrically conductive hose connector 16 extending from a surface of the flange and having an opening in communication with a fluid path through the flange. Discharge structure 28 is associated with the hose connector. The assembly also includes at least one hose 17 for carrying fuel. The hose has an electrically conductive inner layer 27 defining an inner diameter thereof. A portion 22 of the hose connector is received in within the inner diameter of the hose so that the portion contacts the inner layer 27 of the hose, with at least a portion of the discharge structure 28 being accessible outside of the hose. The discharge structure 28 is constructed and arranged to be electrically connected to a terminal of a wiring harness of the fuel supply unit to thereby discharge an electric load in the hose.

19 Claims, 3 Drawing Sheets

FUEL FLANGE WITH DISCHARGE STRUCTURE TO DISCHARGE CONDUCTIVE HOSES

This application claims the benefit of the earlier filing date of U.S. Provisional Application No. 60/738,817, filed on Nov. 22, 2005, which is incorporated by reference herein in its entirety.

FIELD OF THE INVENTION

The invention relates to fuel supply units for automobile vehicles and more particularly, to grounding conductive hoses of a fuel supply unit.

BACKGROUND OF THE INVENTION

A typical fuel supply unit for a vehicle includes a plastic, non-conductive flange configured to be sealed to a wall of a fuel tank. The flange is interconnected with a suction unit. In fuel supply units with conductive components and conductive hoses, an electrical load must be discharged. Since conductive hoses are only conductive on the inside thereof, they need to be discharged from the inside.

Accordingly, there is a need provide a components of a fuel supply unit that are capable of discharging conductive hoses.

SUMMARY OF THE INVENTION

An object of the invention is to fulfill the need referred to above. In accordance with the principles of the present invention a body and hose assembly is provided for a fuel supply unit of a vehicle. The assembly includes a body and an electrically conductive hose connector extending from a surface of the body and having an opening in communication with a fluid path through the body. Discharge structure is associated with the hose connector. The assembly also includes at least one hose for carrying fuel. The hose has an electrically conductive inner layer defining an inner diameter thereof. A portion of the hose connector is received in within the inner diameter of the hose so that the portion contacts the inner layer of the hose, with at least a portion of the discharge structure being accessible outside of the hose. The discharge structure is constructed and arranged to be electrically connected to a terminal of a wiring harness of the fuel supply unit to thereby discharge an electric load in the hose. The body can be a flange, a pump, an inline-filter or other component of the fuel supply unit.

In accordance with another aspect of the invention, a method of discharging an electrical load in a hose of a fuel supply unit of a vehicle is provided. The hose is constructed and arranged to carry fuel and has an electrically conductive inner layer defining an inner diameter thereof. The fuel supply unit has an electrical harness. The method provides an electrically conductive hose connector extending from a surface of a body of a component of the fuel supply unit and having an opening in communication with a fluid path associated with the body. Discharge structure is associated with the hose connector. A portion of the hose connector is received within the inner diameter of the hose so that the portion contacts the inner layer of the hose, with at least a portion of the discharge structure being accessible outside of the hose. The discharge structure is electrically connected to a terminal of a wiring harness such that electrical load in the hose can be discharged via the hose connector, discharge structure and the wiring harness.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENTS

Figure 1:
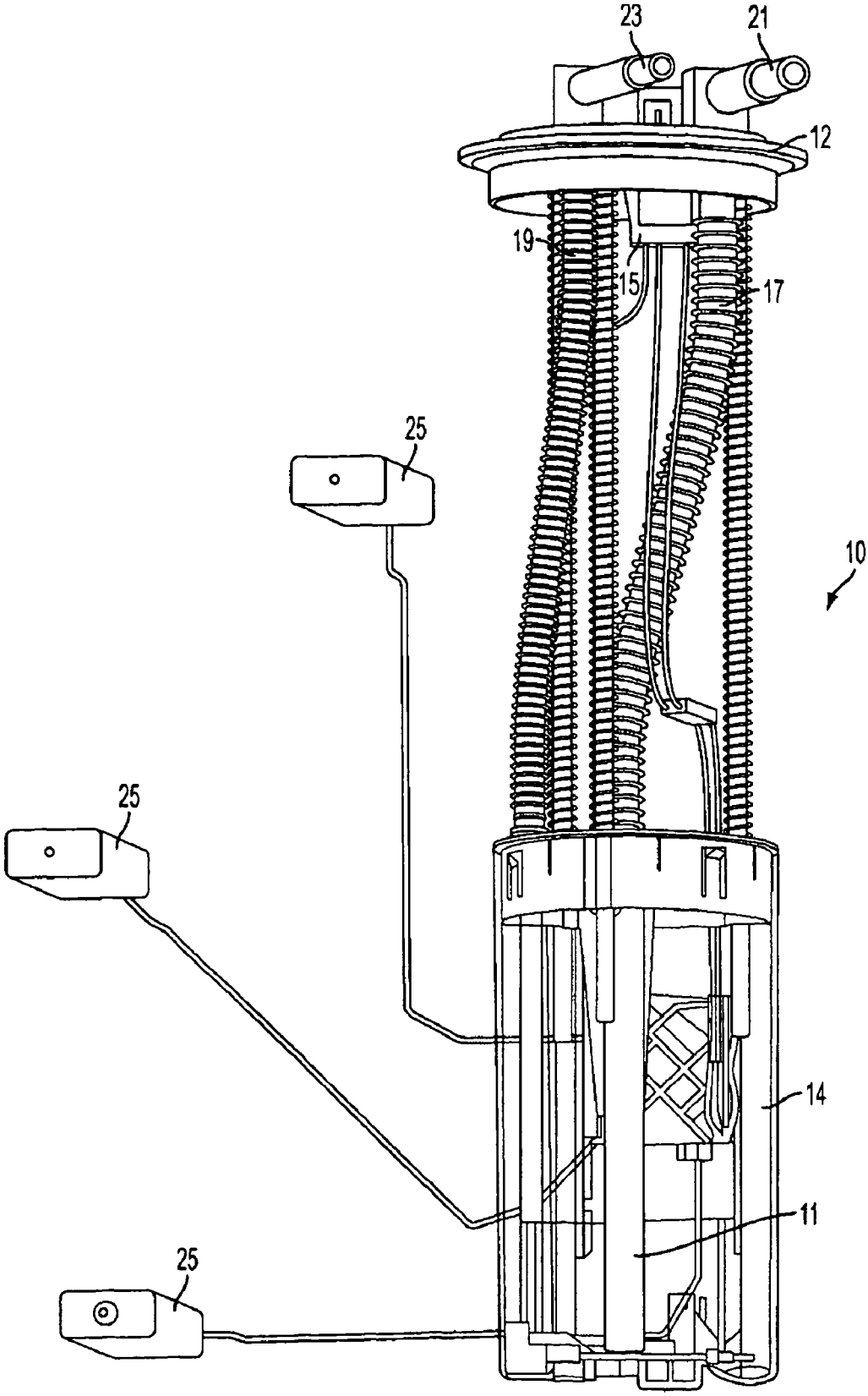
FIG. 1 is a perspective view of a fuel supply unit showing a flange connected with suction unit in accordance with an embodiment of the present invention, shown with hoses connected between the flange and suction unit.

With reference to FIG. 1, a fuel supply unit is shown, generally indicated at 10, in accordance with the principles of an embodiment of the present invention. The fuel supply unit 10 includes a plastic flange 12 that is mounted to a fuel tank (not shown). The flange 12 is connected to a suction unit 14 that is disposed within the fuel tank. More particularly, the suction unit 14 includes a pick-up tube 11 that is fluidly coupled with a supply hose 17 that is coupled to a supply port 21 of the flange 12. A return hose 19 is coupled with a return port 23 of the flange and extends to the suction unit 14. Level senders 25 are also provided.

A vacuum, created by the engine or injection system (diesel applications) pulls the fuel (e.g., diesel) through the pick-up tube and supply hose 17 which is sent to the engine. Excess fuel from the engine is returned through the return hose 19. Since fairly high flow rates are sometimes generated, the hoses 17 and 19 need to be electrically discharged.

Figure 2:
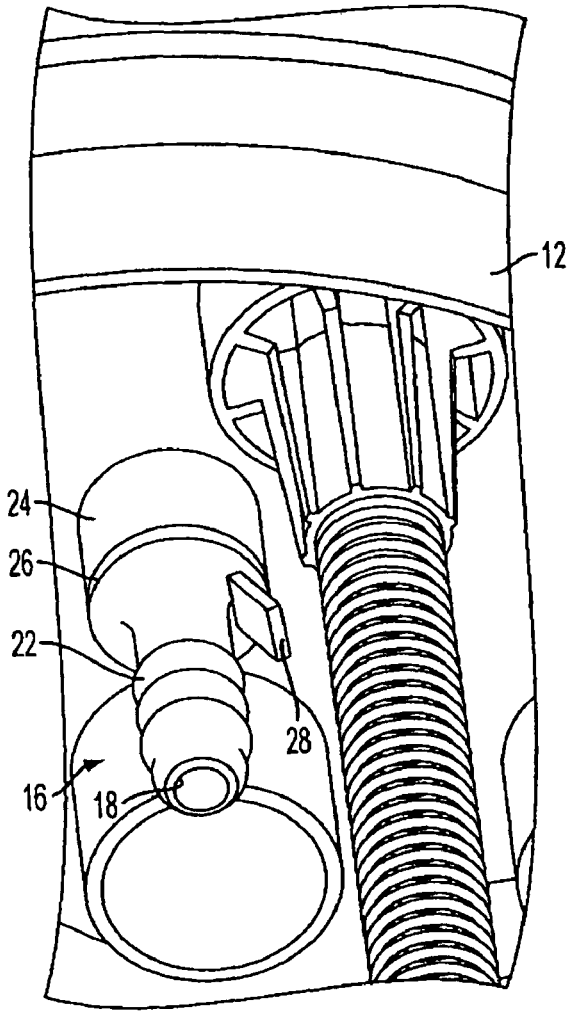
FIG. 2 is an enlarged view of a portion of an underside of the flange of FIG. 1 showing a hose connector including discharge structure provided in accordance with the principles of the present invention.

With reference to FIG. 2, an underside portion of the fuel supply unit flange 10 is shown. In accordance with the illustrated embodiment, the flange 12 includes, at an underside thereof, at least one electrically conductive hose connector, generally indicated at 16, having an opening 18 in communication with a fluid path through the flange 12. More particular, the opening 18 of the hose connector 12 communicates with the supply tube 21 (FIG. 1) on the other side of the flange 12. A similar hose connector 12 is provided for the return port 23.

Figure 3:
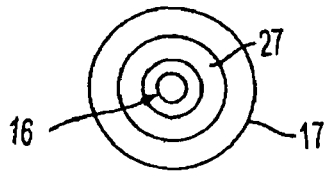
FIG. 3 is an end view of a hose, having a conductive layer, shown coupled to a hose connector in accordance with the invention.

As shown in FIG. 2, the hose connector 16 preferably has a barbed end 22 that is received in an end of the hose 17 (FIG. 3). The hose connector 16 is preferably composed of conductive plastic and the barbed end 22 engages an electrically conductive inner layer 27 defining an inner diameter (FIG. 3) of the hose 17. In the embodiment, the hose connector 16 includes discharge structure, preferably in the form of an insert molded or over-molded metal ring 26 that includes a tab 28 or other interface extending there-from. The tab 28 is accessible outside of the hose 20 and is constructed and arranged to be electrically connected with a terminal of the electrical wire harness 15 (FIG. 1). Alternatively, the discharge structure 26 or tab 28 can be of solid metal or any other conductive material, such as conductive plastic, integral with or separate from the hose connector 16.

Since the hose connector 16 is electrically conductive and is in contact with the conductive inner layer of the hose 17, an electrical load in the hose 17 can be discharged via the hose connector 16, the discharge structure in the form of a metal ring 26 and tab 28, and through the wiring harness 15.

The plastic flange is preferably molded together with the conductive plastic hose connector so as to be integral therewith. In the illustrated embodiment, the flange 12 includes a boss 24 to which the hose connector 16 is molded or otherwise coupled thereto. As shown in FIG. 2, the metal ring 26 is adjacent to the boss 24.

Figure 4:
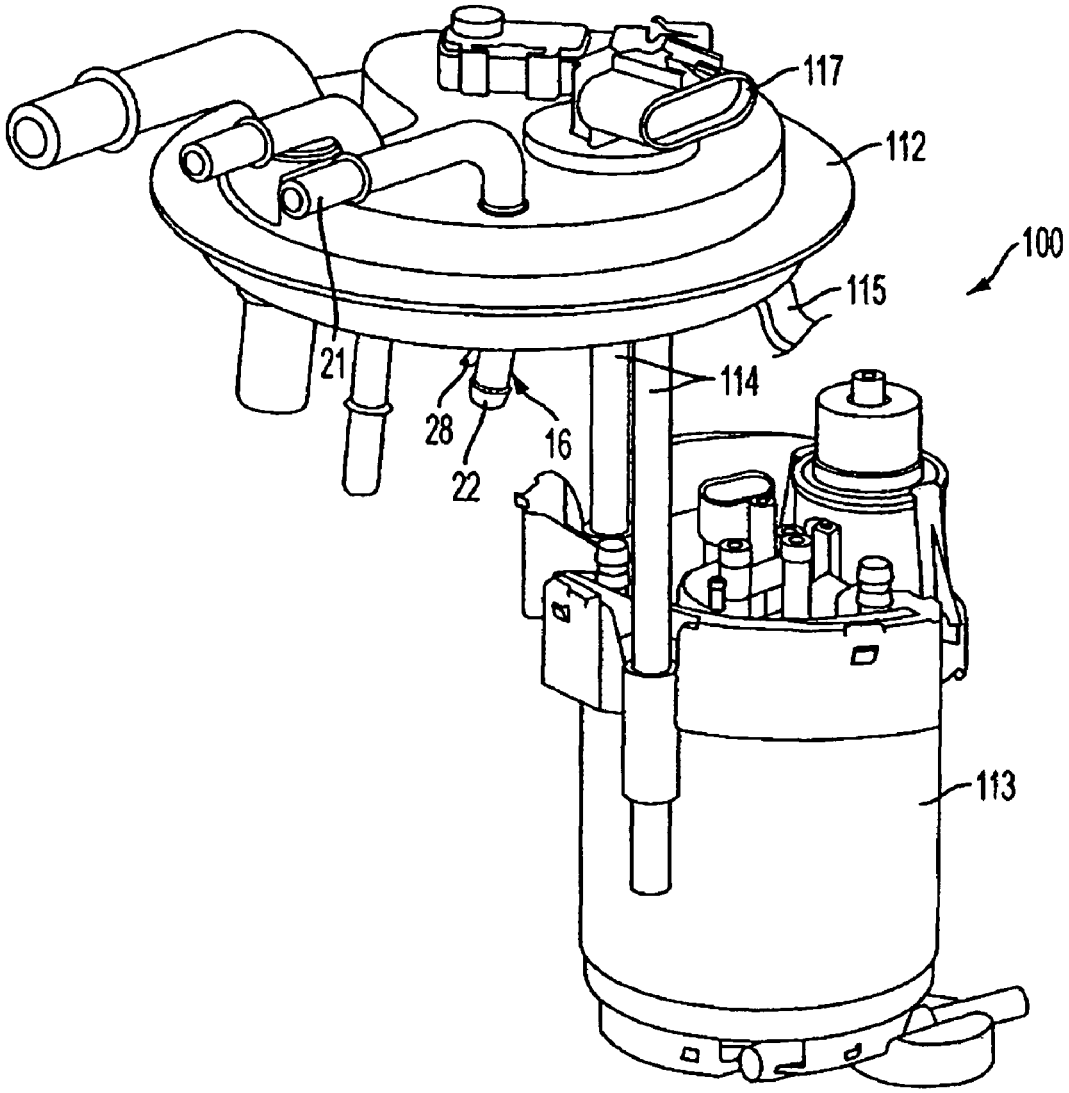
FIG. 4 is a perspective view of a fuel supply unit showing a flange connected with a fuel pump via struts in accordance with an embodiment of the present invention, and shown without hoses connected between the flange and pump.

Although the hose connector 16 was described with regard to suction units, with reference to FIG. 4, it can be appreciated that the hose connector 16 can be employed in a fuel supply unit 100 having a flange 112 interconnected with a fuel pump assembly 113 by a pair of struts 114. In these applications, the fuel can be gasoline, diesel or flex fuel. Note that the hoses 17 and 19 are not shown in FIG. 4. The wiring harness 115 extends through the flange 112 for powering the pump assembly 113 via connector 117 disposed on the outside portion of the flange 112. As in the embodiment of FIG. 1, the hose connector 16 is discharged via the wiring harness 115.

Thus, electrical discharge can be facilitated at every accessible interface between conductive hose and the mating barb structure provided on a body. For example, these interfaces can be between the flange and hose, between hose and suction unit, or between hose and pump or hose and in-line filter (for pump modules). Thus, discharge structure can be associated with either end of a conductive hose via a hose connector.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A body and hose assembly of a fuel supply unit of a vehicle, the assembly comprising:

a body, an electrically conductive hose connector extending from the body and having an opening in communication with a fluid path associated with the body, electrically conductive discharge structure associated with the hose connector, the discharged structure including a metal ring molded together with the hose connector, the metal ring including a tab extending there-from, and at least one hose for carrying fuel, the hose having an electrically conductive inner layer defining an inner diameter thereof, a portion of the hose connector being received in within the inner diameter of the hose so that the portion of the hose connector contacts the inner layer of the hose, with at least a portion of the tab being accessible outside of the hose, wherein the portion of the tab is constructed and arranged to be electrically connected to a terminal of a wiring harness of the fuel supply unit to thereby discharge an electric load in the hose.

2. The assembly of claim 1, wherein the body is a plastic flange constructed and arranged to be mounted to a fuel tank.

3. The assembly of claim 1, wherein the hose connector is composed of electrically conductive plastic.

4. The assembly of claim 3, wherein the body and hose connector are integrally formed.

5. The assembly of claim 1, wherein the hose connector includes a barbed end engaging the inner layer of the hose.

6. The assembly of claim 1, in combination with the wiring harness, the tab being electrically connected to the terminal of the wiring harness.

7. The assembly of claim 2, wherein the flange includes a boss to which the hose connector is connected.

8. The assembly of claim 7, wherein the metal ring is adjacent to the boss.

9. The assembly of claim 2, in combination with a suction unit, the suction being fluidly coupled with the flange through the hose, wherein fuel is drawn from a fuel tank through the suction unit and hose, and through the fluid path of the flange.

10. A flange and hose assembly of a fuel supply unit of a vehicle, the assembly comprising:

a plastic flange constructed and arranged to be mounted to a fuel tank, electrically conductive means, extending from a surface of the flange for connecting to a hose, the electrically conductive means having an opening in communication with a fluid path through the flange, means for discharging an electrical load associated with the electrically conductive means, and at least one hose for carrying fuel, the hose having an electrically conductive inner layer defining an inner diameter thereof, a portion of the electrically conductive means being received in within the inner diameter of the hose so that the portion of the electrically conductive means contacts the inner layer of the hose, with at least a portion of the means for discharging being accessible outside of the hose, wherein the means for discharging includes a metal ring molded together with the hose connector, the metal ring including a tab extending there-from and defining the portion accessible outside of the hose, wherein the tab is constructed and arranged to be electrically connected to a terminal of a wiring harness of the fuel supply unit to thereby discharge an electric load in the hose.

11. The assembly of claim 10, wherein the electrically conductive means is a hose connector composed of electrically conductive plastic.

12. The assembly of claim 11, wherein the flange and hose connector are integrally formed.

13. The assembly of claim 11, wherein the hose connector includes a barbed end engaging the inner layer of the hose.

14. The assembly of claim 10, in combination with the wiring harness, the tab being electrically connected to the terminal of the wiring harness.

15. The assembly of claim 10, wherein the flange includes a boss associated with the hose connector.

16. The assembly of claim 15, wherein the metal ring is adjacent to the boss.

17. The assembly of claim 10, in combination with a suction unit, the suction being fluidly coupled with the flange through the hose, wherein fuel is drawn from a fuel tank through the suction unit and hose, and through the fluid path of the flange.

18. A method of discharging an electrical load in a hose of a fuel supply unit of a vehicle, the hose being constructed and arranged to carry fuel and has an electrically conductive inner layer defining an inner diameter thereof, the fuel supply unit having an electrical harness, the method including:

providing an electrically conductive hose connector extending from a body of a component of the fuel supply unit and having an opening in communication with a fluid path associated with the body, providing electrically conductive discharge structure associated with the hose connector, the discharged structure including a metal ring molded together with the hose connector, the metal ring including a tab extending there-from, receiving a portion of the hose connector within the inner diameter of the hose so that the portion of the hose connector contacts the inner layer of the hose, with at least a portion of the tab being accessible outside of the hose, and electrically connecting the tab to a terminal of a wiring harness such that electrical load in the hose can be discharged via the hose connector, discharge structure and the wiring harness.

19. The method of claim 18, wherein the body is a flange constructed and arranged to be mounted to fuel tank, the flange being is composed of non-electrically conductive plastic and the hose connector being composed of electrically conductive plastic.

* * * * *